US008786383B2

(12) United States Patent
Dupuy

(10) Patent No.: US 8,786,383 B2
(45) Date of Patent: Jul. 22, 2014

(54) METAMATERIAL DIPLEXERS, COMBINERS AND DIVIDERS

(75) Inventor: Alexandre Dupuy, San Diego, CA (US)

(73) Assignee: Hollinworth Fund L.L.C., Dover, DE (US)

( * ) Notice: Subject to any disclaimer, the term of this patent is extended or adjusted under 35 U.S.C. 154(b) by 533 days.

(21) Appl. No.: 13/084,667

(22) Filed: Apr. 12, 2011

(65) Prior Publication Data

US 2011/0248791 A1 Oct. 13, 2011

Related U.S. Application Data

(60) Provisional application No. 61/323,211, filed on Apr. 12, 2010.

(51) Int. Cl.
*H01P 1/10* (2006.01)
*H01P 5/12* (2006.01)

(52) U.S. Cl.
USPC ..... 333/101; 333/126

(58) Field of Classification Search
USPC ..... 333/101, 103, 104, 105, 107, 120, 126, 333/127, 128
See application file for complete search history.

(56) References Cited

U.S. PATENT DOCUMENTS

| | | | | |
|---|---|---|---|---|
| 7,839,236 | B2 | 11/2010 | Dupuy et al. | |
| 8,462,063 | B2 * | 6/2013 | Gummalla et al. | 343/745 |
| 2008/0258993 | A1 * | 10/2008 | Gummalla et al. | 343/876 |
| 2009/0295473 | A1 | 12/2009 | Dupuy et al. | |
| 2010/0207703 | A1 | 8/2010 | Dupuy et al. | |

OTHER PUBLICATIONS

Itoh, "Invited paper: Prospects for Metamaterials," Electronics Letters, vol. 40, No. 16 (Aug. 2004).

* cited by examiner

*Primary Examiner* — Dean O Takaoka
(74) *Attorney, Agent, or Firm* — Novak Druce Connolly Bove + Quigg LLP

(57) ABSTRACT

A wireless device having a CRLH structure incorporates a power combiner/divider and diplexer. In one embodiment, circuit parameters are selected to achieve impedance matching using a transmission line structure.

20 Claims, 13 Drawing Sheets

METAMATERIAL DIPLEXERS, COMBINERS AND DIVIDERS

PRIORITY CLAIMS AND RELATED APPLICATIONS

This application claims the benefit of priority under 35 U.S.C. 119(e) to U.S. Provisional Patent Application Ser. No. 61/323,211 entitled "METAMATERIAL DIPLEXERS, COMBINERS AND DIVIDERS" and filed on Apr. 12, 2010, which is incorporated herein by reference in its entirety.

BACKGROUND

The present invention relates to Radio Frequency (RF) components, including diplexers, combiners and diplexers. Wireless devices require RF components to prepare signals for transmission and to process received signals. It is desirable that RF components be minimal in size and configured for a variety of device designs.

DESCRIPTION

The present discussion relates to Radio Frequency (RF) processing elements for a wireless device. These elements are often configured in the Front End Module (FEM) of a wireless device coupled to the antenna or radiator. Such elements include diplexers, power combiners and dividers, and systems. According to some embodiments, these RF processing elements or RF components are based on Composite Right and Left Handed (CRLH) structures. Using CRLH structures for a power combiner/divider, one or more CRLH unit cells is configured in each feed path between a branch point and a feed point, such as where there are a branch point and M feed points, wherein ($1 \leq M \leq N$) and N is the number of cells. The number of unit cells and equivalent circuit parameters representing the unit cell may be chosen to have adequate phases for underlying applications. There are a variety of CRLH structures that may be implemented and configured to achieve performance of RF components.

Implementations and properties of various CRLH structures are described in, for example, Caloz and Itoh, "Electromagnetic Metamaterials: Transmission Line Theory and Microwave Applications," John Wiley & Sons (2006). CRLH structures and their applications in antennas are described by Tatsuo Itoh in "Invited paper: Prospects for Metamaterials," Electronics Letters, Vol. 40, No. 16 (August, 2004). Designs, implementations and variations of multiband power combiners/dividers based on CRLH structures are described, for example, in the U.S. patent application Ser. No. 11/963,710, entitled "Power Combiners and Dividers Based on Composite Right and Left Handed Metamaterial Structures," filed on Dec. 21, 2007. Designs, implementations and variations of diplexers, multiplexers, power amplifying systems, and other RF components and systems based on CRLH structures are described, for example, in the U.S. patent application Ser. No. 12/474,270, entitled "Power Amplifier Architectures," filed on May 28, 2009; and Ser. No. 12/708,437, entitled "Metamaterial Power Amplifier Systems," filed on Feb. 18, 2010.

Figure 1:
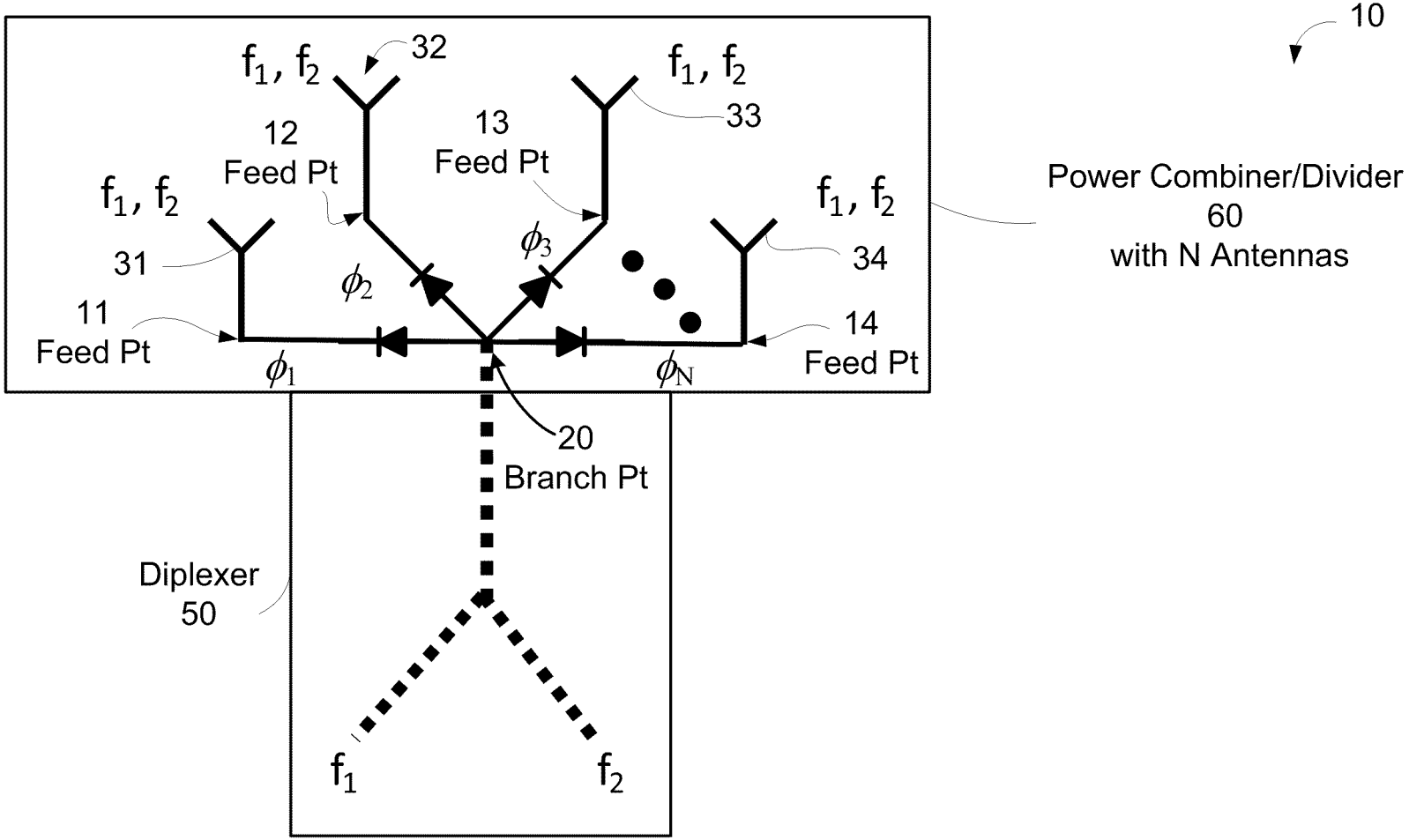
FIG. 1 illustrates a wireless device having a power combiner/divider incorporating multiple antennas, according to example embodiments.

FIG. 1 illustrates a system 10 including a diplexer 50 and a power combiner/divider 60 for a dual-band operation of multiple antennas. The diplexer 50 is indicated by dotted lines having three ports. The first port adapted to support a first frequency, $f_1$, a second port adapted to support a second frequency, $f_2$, and a third port coupling to a power combiner/divider 60. The power combiner/divider 60 is structured to form a radial configuration in this example, in which N branches have a common point, i.e., a branch point 20, coupled to the diplexer 50, and each branch has a distal end as a feed point for one of the antennas 1, 2 . . . and N, such as antennas 31, 32, 33, . . . 34. One or more of the antennas may be selected for beam forming and radiation pattern shaping purposes, e.g., directional and omnidirectional pattern forming, by controlling ON/OFF of diodes or switches. As an example, the system of FIG. 1 includes diodes, each placed on a feed path between the branch point 20 and each feed point M ($1 \leq M \leq N$). From branch point 20 the various feed paths are directed to the antennas through feed points, including feed point 11 to antenna 31, feed point 12 to antenna 32, feed point 13 to antenna 33, and feed point 14 to antenna 34.

Continuing with FIG. 1, the antennas, the diplexer 50 and the power combiner/divider 60 in this example may be designed based on CRLH structures to operate for the dual-band represented by frequencies $f_1$ and $f_2$. The frequencies $f_1$ and $f_2$ in this document are used to represent ranges of frequencies around $f_1$ and $f_2$ so as to accommodate frequency fluctuations and/or bandwidths within the respective ranges. The dual-band scheme illustrated in FIG. 1 may be extended to a multi-band scheme by utilizing, for example, extended CRLH (E-CRLH) structures. Techniques to design CRLH-based RF components for dual-band and multiband operations are described in the aforementioned US patent applications.

When CRLH structures are used for the power combiner/divider 60, each feed path between the branch point 20 and a given feed point M ($1 \leq M \leq N$) may include one or more CRLH unit cells (not shown). The unit cells each have a cell patch, or radiating element, capacitively coupled to a feed; wherein the cell patch is inductively loaded to ground, and is positioned so as to reduce the capacitance between ground and the cell patch. The number of unit cells and equivalent circuit parameters representing the unit cell may be chosen to have adequate phases for underlying applications. In the present dual-band case, the phase $\phi_M$ associated with the $M^{th}$ feed path may be selected from the values of $\pm k\times180°$ (k=0, 1, 2 . . . ), e.g., $\phi_M=0$ at $f_1$ and $\phi_M=180°$ at $f_2$. Such a selection of phases provides an open circuit at the feed point M when the diode on the $M^{th}$ feeding path is reverse-biased, thereby promoting power transfer to the other paths that are forward-biased.

Figure 2:
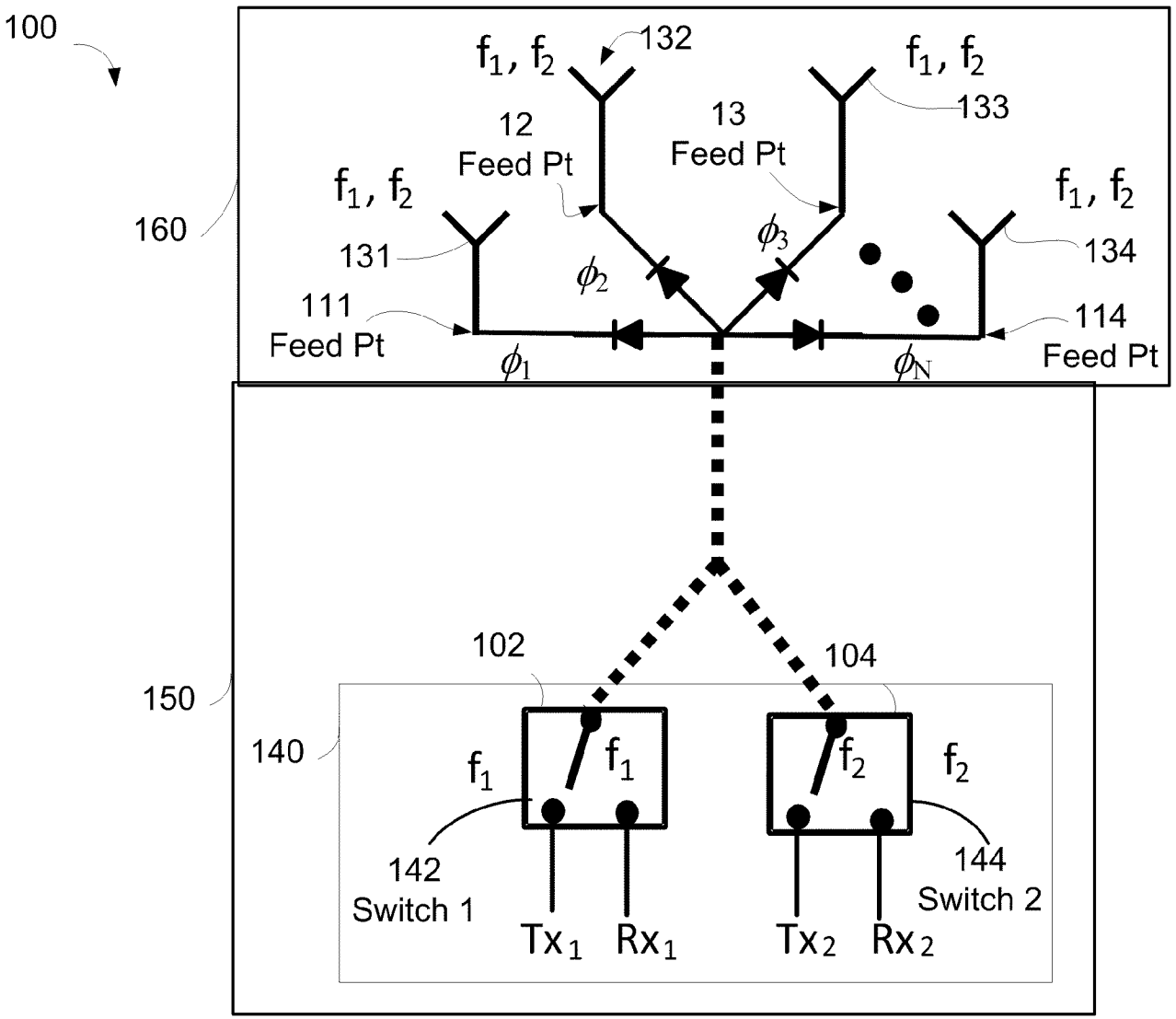
FIG. 2 illustrates a wireless device having a power combiner/divider, incorporating multiple antennas, coupled to a diplexer having switch functionality, according to example embodiments.

FIG. 2 illustrates a communication system 100 including a Transmit (Tx)/Receive (Rx) switching module 140 between transmit (Tx) inputs and receive (Rx) outputs, which may be additional to the configuration of system 10 of FIG. 1. Switches 142, 144, are coupled to input ports (when Tx is on) or output ports (when Rx is on) of the diplexer 150 to select a Tx path or an Rx path. Switches 142, 144 may be Single-Pole double-Throw (SP2T) switches, or may be other types of switching devices. In the illustrated example, the switching module 140 is part of the diplexer 150 as illustrated, but alternate embodiments may place the switching functionality outside the diplexer 150. As illustrated, the switch 142 is used to process signals of frequency $f_1$ while switch 144 is used to process signals of frequency $f_2$. Processing thereafter continues as for the system 10 of FIG. 1. Operation of the power combiner/divider 160 is similar to that of device 60, including feed point 111 to antenna 131, feed point 12 to antenna 132, feed point 13 to antenna 133, and feed point 114 to antenna 134.

Figure 3:
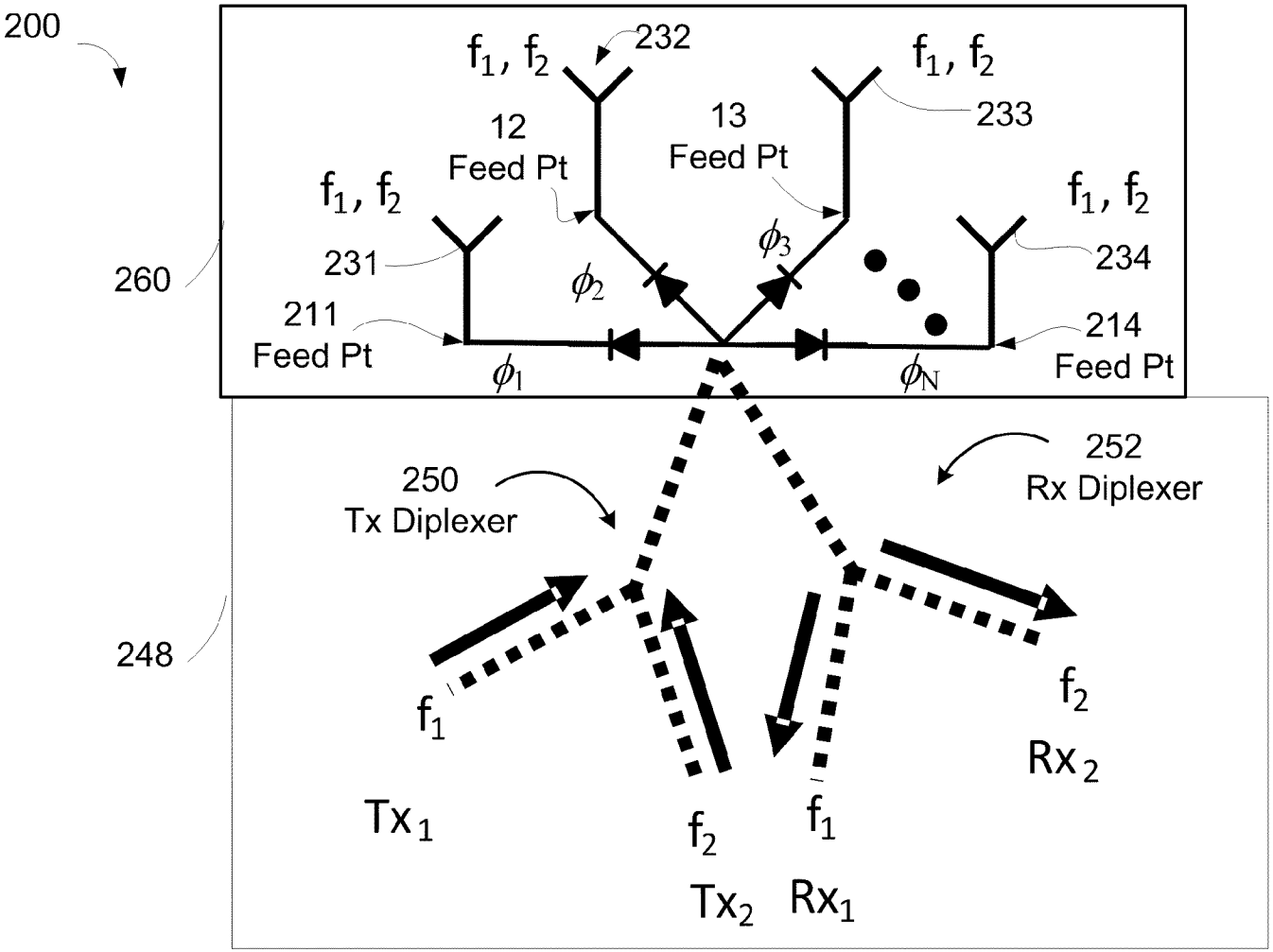
FIG. 3 illustrates a wireless device having a power combiner/divider, incorporating multiple antennas, coupled to a diplexer having multiple diplexer paths, according to example embodiments.

FIG. 3 illustrates a system 200 including a diplexer 248 having two diplexer paths, or individual diplexers, instead of the single diplexer 50 in the system 10 of FIG. 1. One diplexer, a Tx diplexer path 250, is coupled to a Tx path to transmit the signals in the Tx dual-band through the power divider/divider 260 to the multiple antennas 231, 232, 233, 234. The other diplexer, Rx diplexer path 252, is coupled to an Rx path so that the signals in the Rx dual-band received at the multiple antennas are sent through the power combiner/divider 260 to the Rx diplexer path 252. Operation within power combiner/divider 260 is similar to that of power combiner/divider 60 of FIG. 1, including feed point 211 to antenna 231, feed point 12 to antenna 232, feed point 13 to antenna 233, and feed point 214 to antenna 234. In the embodiment of FIG. 3, diplexer 248 adds flexibility to the diplexer 50 of FIG. 1.

Figure 4:
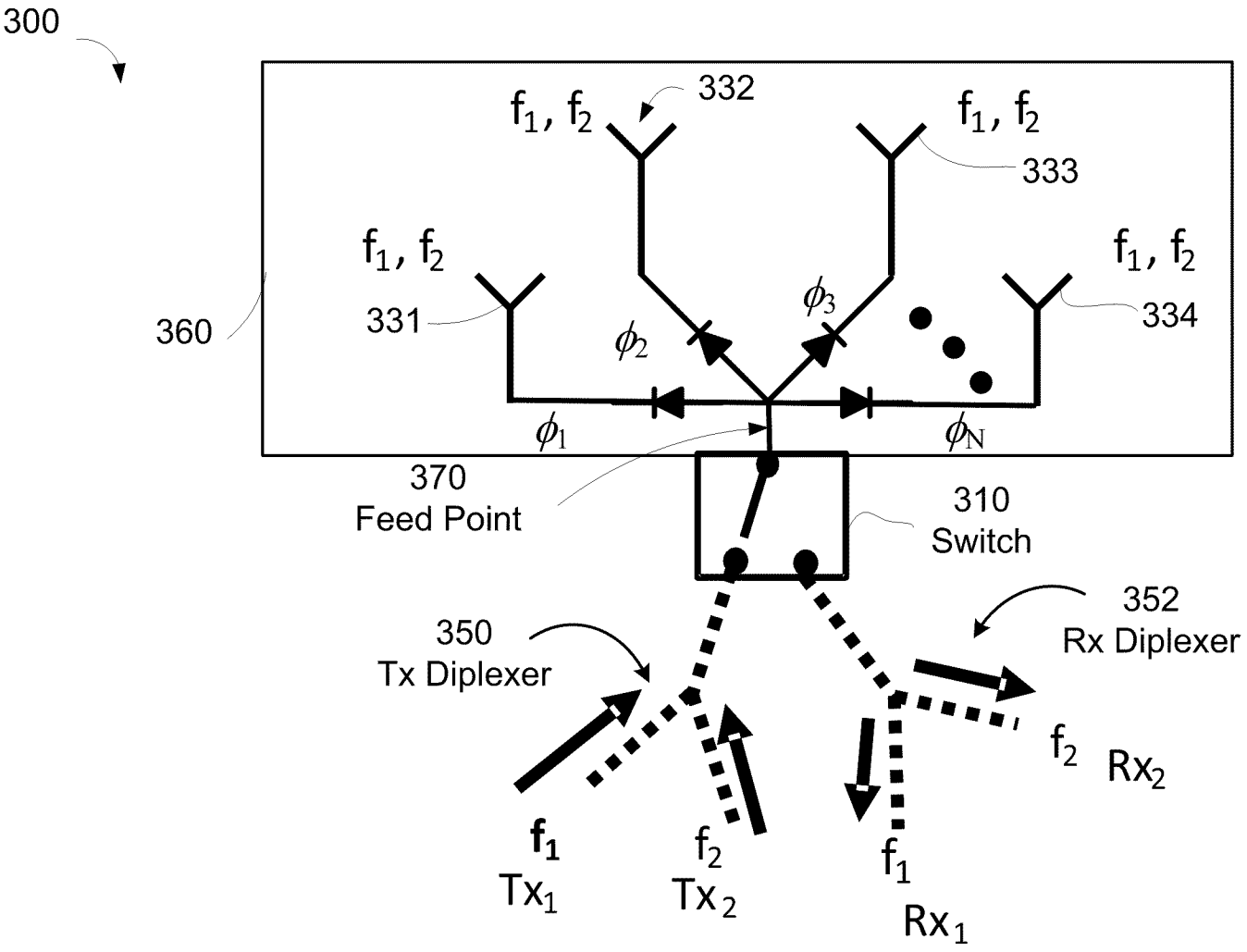
FIG. 4 illustrates a wireless device as in FIG. 3 with switching functionality to support transmit and receive frequency band signals, according to example embodiments.

FIG. 4 illustrates a system 300 including a Tx/Rx switching scheme between two diplexers 350, 352, and the feed point 370. The Tx/Rx switch 310 is additional to the system 200 of FIG. 3. In one embodiment, the switch 310 is an SP2T switch, for example, which may be controlled to select the Tx diplexer 350 or the Rx diplexer 352 depending on whether the operation is in the Tx mode or in the Rx mode. Operation within power combiner/divider 360 is similar to that of power combiner/divider 260 of FIG. 3 to cooperate with antennas 331, 332, 333 and 334. As illustrated in these examples, the use of switching techniques may be used in collaboration with the CRLH elements to support a variety of operating specifications and conditions.

Figure 5:
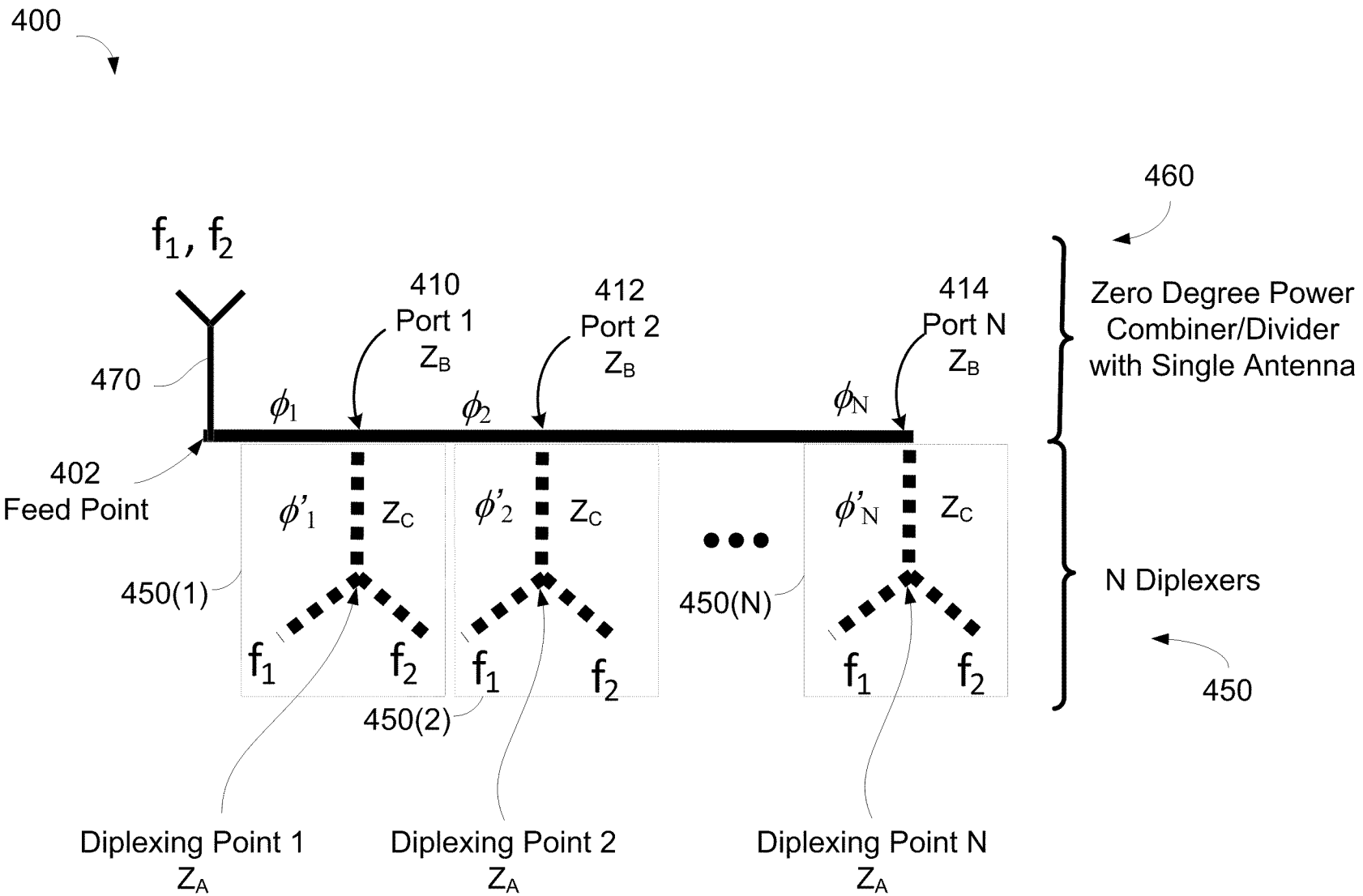
FIG. 5 illustrates a wireless device having a power combiner/divider transmission line structure coupled to one antenna, according to example embodiments.

FIG. 5 illustrates a system 400 having a power combiner/divider 460 and multiple diplexers 450 and a single antenna 470. The power combiner/divider 460 is a zero degree power combiner/divider structured to form a transmission line in this example, in which the multiple diplexers 450 are coupled to the zero degree power combiner/divider 460 at port 1 410, port 2 412 . . . port N 414, respectively. One end of the zero degree power combiner/divider 460 is coupled to the antenna 470 at a feed point 402. The multiple diplexers 450 and the zero degree power combiner/divider 460 allow for dual-band operation using a single antenna 470. Each of the N diplexers 450 is indicated by dotted lines having three ports, where N is the number of diplexers. The antenna 470, the diplexers 450 and the zero degree power combiner/divider 460 in this example may be designed based on CRLH structures to operate for the dual-band represented by frequencies $f_1$ and $f_2$. The diplexers 450 are indicated as diplexer 450(1), 450(2), . . . , 450(N), each having a first port for a first frequency, $f_1$, a second port for a second frequency, $f_2$, and third port coupled to the zero degree power combiner/divider 460. Each has a diplexing point having an impedance $Z_A$; each is coupled to the transmission line structure of the power combiner/divider 460 having an impedance $Z_B$ at the corresponding port.

When CRLH structures are used for the zero degree power combiner/divider 460, each segment, between the feed point 402 and the port 1, between the port 1 and the port 2 . . . , or between the port N−1 and the port N, may include one or more CRLH unit cells (not shown). The number of unit cells and equivalent circuit parameters representing the unit cell may be chosen to have adequate phases for the underlying applications. In the present dual-band case, the phase $\phi_M$ associated with the $M^{th}$ segment ($1\leq M\leq N$) may be selected from the values of $\pm2k\times180°$ (k=0, 1, 2 . . . ), e.g., $\phi_M=0$ at $f_1$ and $\phi_M=360°$ at $f_2$. Such a selection of phases promotes optimum power transfer for either power combining or dividing for the dual-band operation. In addition, dual-band impedance matching can be carried out by using CRLH structures for the diplexers to further improve power transfer. For example, in the $M^{th}$ diplexer ($1\leq M\leq N$) of the system illustrated in FIG. 5, the branch between the diplexing point M and the port M coupled to the zero degree power combiner/divider can be designed based on CRLH structures. The number of unit cells and equivalent circuit parameters representing the unit cell may be chosen to have adequate phases on this branch to achieve impedance matching. In this example, each of the diplexers has impedance $Z_A$ at the diplexing point and impedance $Z_B$ at the port. The impedance matching can be achieved by choosing the phase $\phi'_M$ associated with the branch of the $M^{th}$ diplexer to have $90°\pm(k\times180°)$, where k=0, 1, 2 . . . , e.g., $\phi'_M=90°$ at $f_1$ and $\phi'_M=270°$ at $f_2$, with impedance $Z_C=(N\times Z_A\times Z_B)^{1/2}$.

Figure 6:
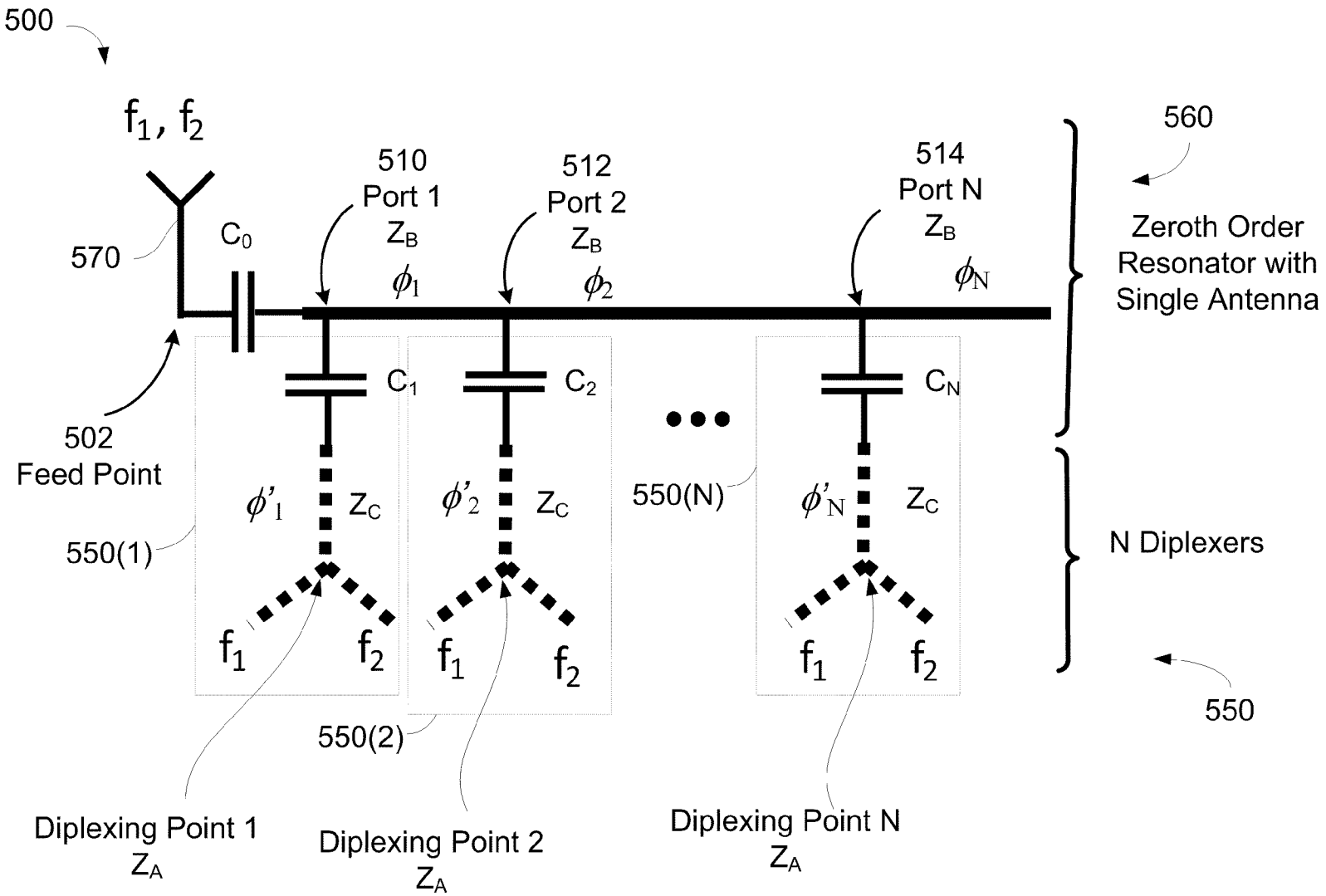
FIG. 6 illustrates a wireless device as in FIG. 5 incorporating a capacitive element between the transmission line and the antenna, according to example embodiments.

FIG. 6 illustrates a system 500 having multiple diplexers 550 and a zeroth order resonator 560 for a dual-band operation of single antenna 570. The zero degree power combiner/divider 460 in the system of FIG. 5 is replaced with the zeroth order resonator 560. Compared to the zero degree power combiner/divider 460, the zeroth order resonator 560 has an additional capacitor $C_0$ between the feed point and the port 1, a capacitor $C_1$ between the port 1 510 and the diplexing point 1, a capacitor $C_2$ between the port 2 520 and diplexing point 2 . . . , and a capacitor $C_N$ between the port N 514 and the diplexing point N, and a transmission line at one end different from the feed point 502 to couple to an output port of the system 500. These capacitors are chosen to have adequate capacitance values for coupling to optimize power transfer. The zeroth order resonator 560 and the multiple diplexers 550 may be designed based on CRLH structures similar to those in the system of FIG. 5 to have specified phase and impedance matching.

Figure 7:
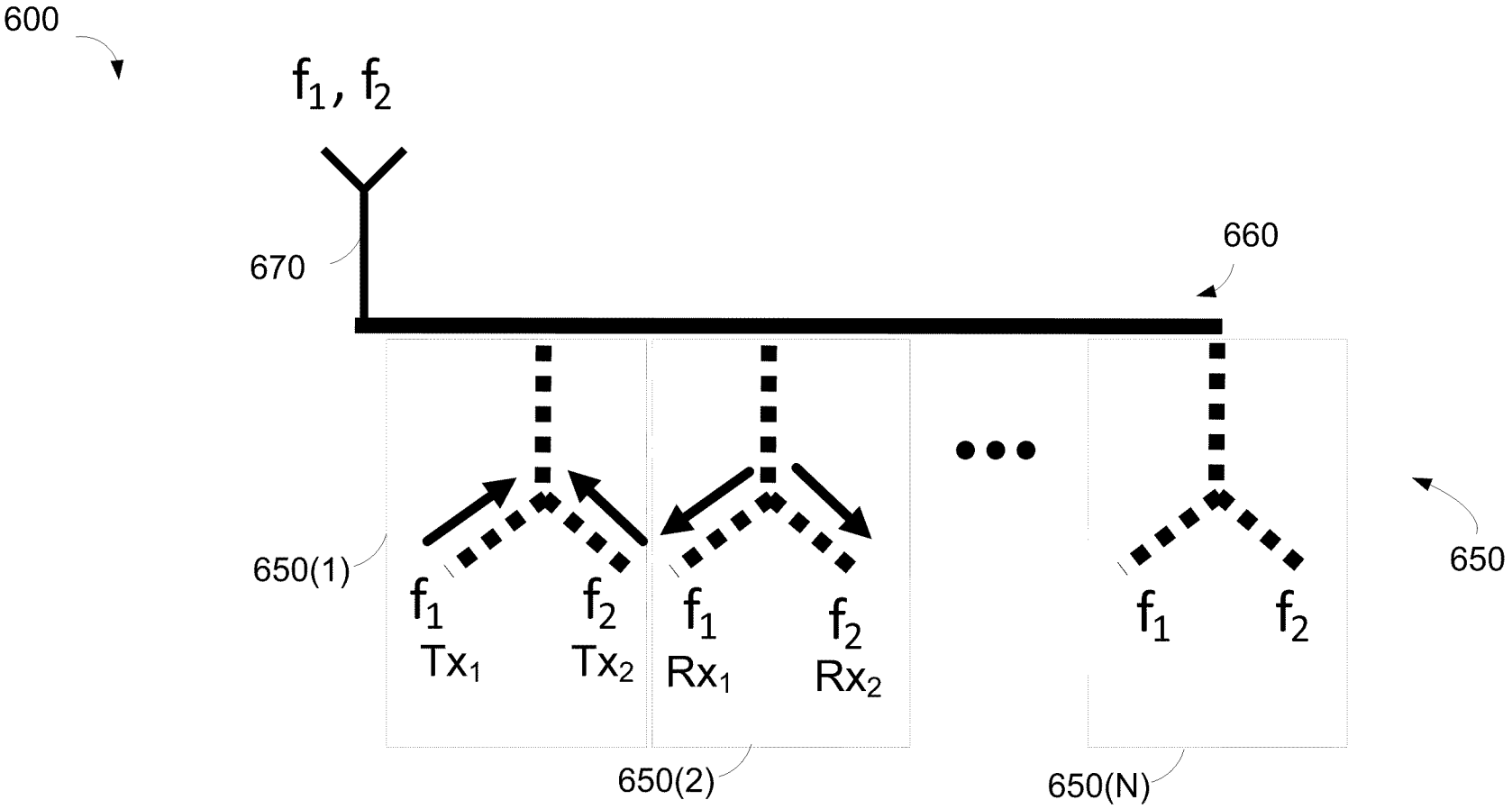
FIGS. 7-8 illustrate wireless devices incorporating power combiner/divider transmission line structures coupled to a plurality of diplexers, each diplexer having multiple diplexer paths, according to example embodiments.

FIG. 7 illustrates a system 600 including multiple diplexers 650, an antenna 670 and a zero degree power combiner/divider 660, similar to the system of FIG. 5. In this example, one of the diplexers is used for the Tx mode to provide a Tx diplexer 650(1), and another diplexer is used for the Rx mode to provide an Rx diplexer 650(2). This configuration may be achieved by coupling the Tx diplexer 650(1) to a transmitter circuit and coupling the Rx diplexer 650(2) to a receiver circuit. Alternatively, diodes or switches may be placed on the diplexer branches coupled to the zero degree power combiner/divider 660 to select the Tx diplexer 650(1) for the Tx mode and the Rx diplexer 650(2) for the Rx mode. The similar functionality can be obtained by using a zeroth order resonator instead of the zero degree power combiner/divider.

Figure 8:
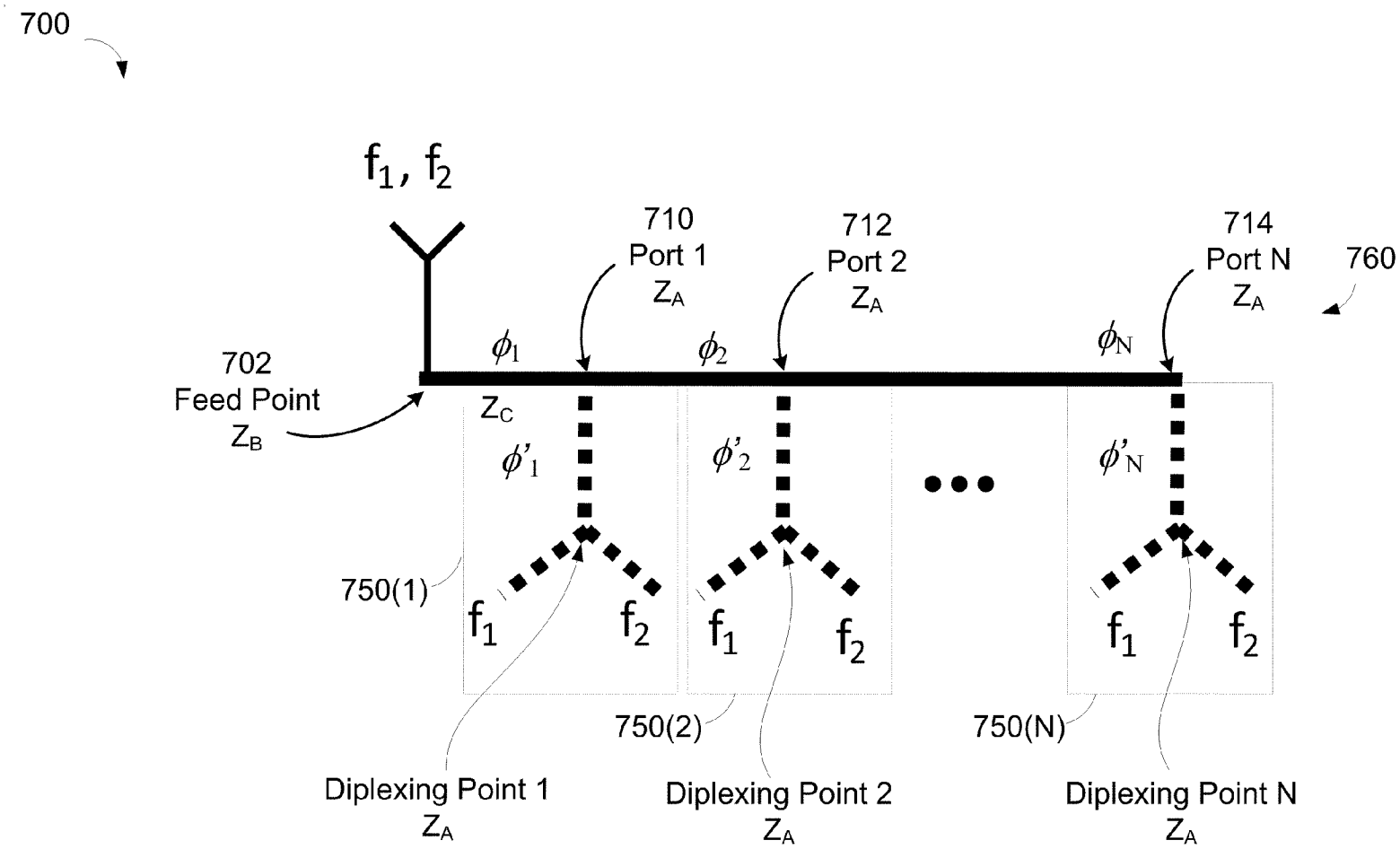

FIG. 8 illustrates a system 700 including multiple diplexers 750 and a zero degree power combiner/divider 760, similar to the system of FIG. 5. This system is structured to have impedance conditions different from those of the system 400 of FIG. 5, thus requiring a different impedance matching scheme. The ports 1 710, 2 712, . . . N 714 and the diplexing points 1, 2 . . . N have the same impedance $Z_A$, but the feed point has different impedance $Z_B$ in this example. In the $M^{th}$ diplexer ($1 \leq M \leq N$), the phase $\phi'_M$ between the diplexing point M and the port M may be chosen from the values of $\pm k \times 180°$ (k=0, 1, 2 . . . ), e.g., $\phi'M=0$ at $f_1$ and $\phi'_M=180°$ at $f_2$, based on the CRLH structure. Such a selection of phases ensures the impedance transformation of $Z_A$ to $Z_A$. The phases $\phi_2$, $\phi_3$, . . . and $\phi_N$ of the respective segments of the zero degree power combiner/divider may be chosen from the values of $\pm k \times 360°$ (k=0, 1, 2 . . . ) as in the system of FIG. 5. The impedance matching between the feed point and the port 1 can be achieved by designing the CRLH structure for the segment to provide the phase $\phi_1=90° \pm (k \times 180°)$, where k=0, 1, 2 . . . , e.g., $\phi_1=90°$ at $f_1$ and $\phi_1=270°$ at $f_2$, with impedance $Z_C=(N \times Z_A \times Z_B)^{1/2}$. The similar functionality can be obtained by using a zeroth order resonator instead of the zero degree power combiner/divider. One or more of the diplexers may be configured to transmit signals in the Tx mode and other one or more of the diplexers may be configured to receive signals in the Rx mode as illustrated in FIG. 7, by using switches or diodes, for example.

Figure 9:
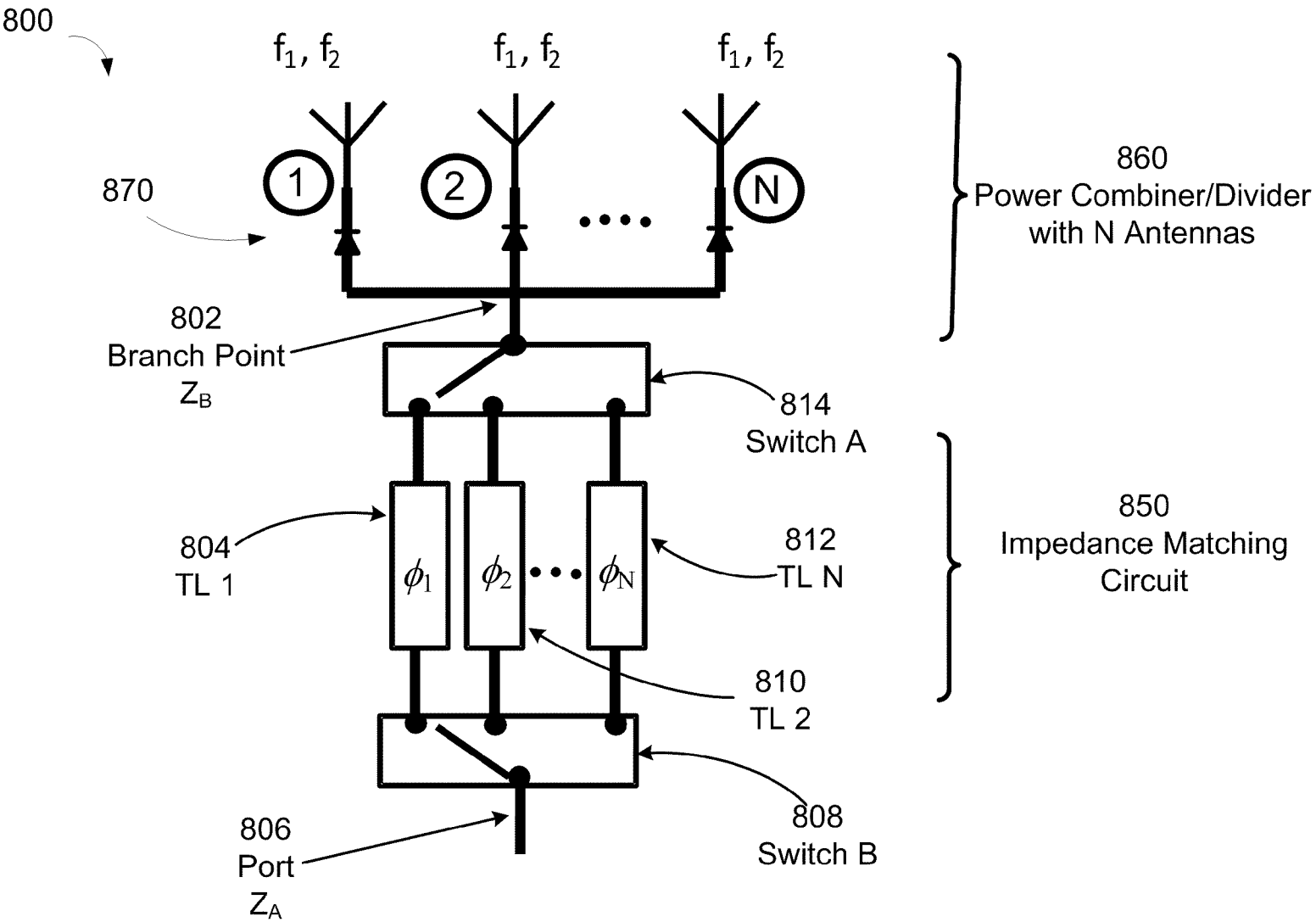
FIGS. 9-13 illustrate wireless devices having various configurations of power combiner/divider circuits, diplexer circuits and antenna elements, according to example embodiments.

FIG. 9 illustrates a system 800 including a power combiner/divider 860, two switches 808, 814 and an impedance matching circuit 850 for a dual-band operation of multiple antennas 870. The impedance matching circuit 850 includes transmission lines TL 1 804, TL 2 810 . . . , TL N 812, which can be designed based on CRLH structures to have adequate phases for impedance matching. The switch A 814 is coupled to first ends of the TLs and the switch B 808 is coupled to second ends of the TLs and port 806. These switches are controlled to select the TL 1 when one antenna is active, the TL 2 when two antennas are active, . . . , and the TL N when N antennas are active. Denoting the impedance at each of the antennas by $Z_0$, the impedance $Z_B$ at the branch point of the power combiner/divider 860 can generally be expressed as $Z_B=Z_0/M$, where M is the number of active antennas and $1 \leq M \leq N$. The impedance matching between the branch point 802 having impedance $Z_B$ and the port having impedance $Z_A$ can be achieved by designing the CRLH structure for the TL M to provide the phase $\phi_M=90° \pm (k \times 180°)$, where k=0, 1, 2 . . . , e.g., $\phi_M=90°$ at $f_1$ and $\phi_M=270°$ at $f_2$, with impedance $Z_M=(Z_A \times Z_B)^{1/2}$ where $Z_B=Z_0/M$. When $Z_A=Z_0$ such as a typical system impedance of 50Ω, the TL1, which is coupled to one antenna (i.e., $Z_A=Z_B=Z_0$), may be structured to have the phase $\phi_1=\pm(k \times 180°)$, where k=0, 1, 2 . . . , e.g., $\phi_1=0°$ at $f_1$ and $\phi_M=180°$ at $f_2$, with an arbitrary impedance value of $Z_1$. This is because the impedance transformation from $Z_A$ to $Z_B$ and vice versa can be achieved by having the phase $\phi_1=\pm(k \times 180°)$ irrespective of the $Z_1$ value when $Z_A=Z_B$.

Figure 10:
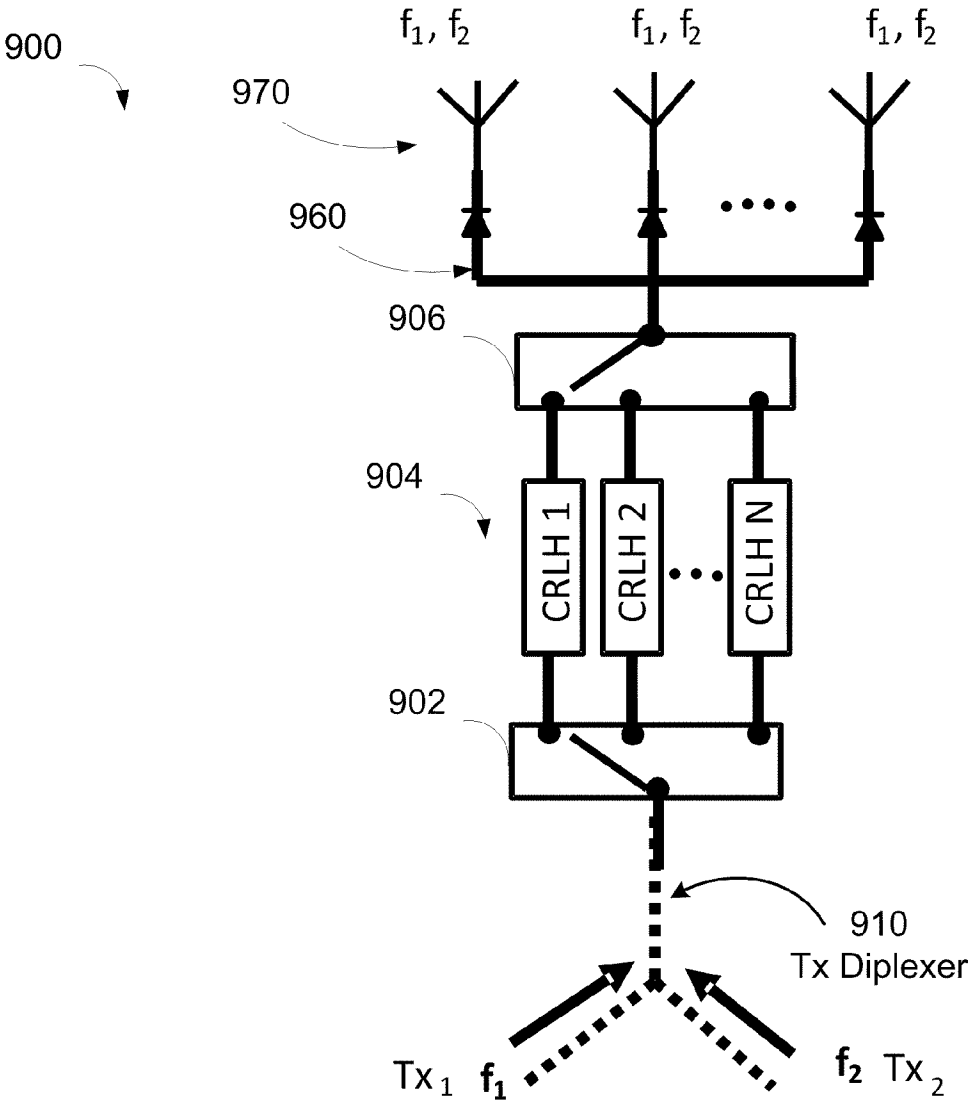

FIG. 10 illustrates a system 900 including a power combiner/divider 960, two switches 906, 902, an impedance matching circuit 904, and a Tx diplexer 910 for a dual-band Tx operation of multiple antennas 970. This system 900 has the Tx diplexer 910, which is additional to the system of FIG. 9. A similar system can be devised by using an Rx diplexer for a dual-band Rx operation. Both the Tx and Rx diplexers may be designed based on CRLH structures to operate for the dual-band.

Figure 11:
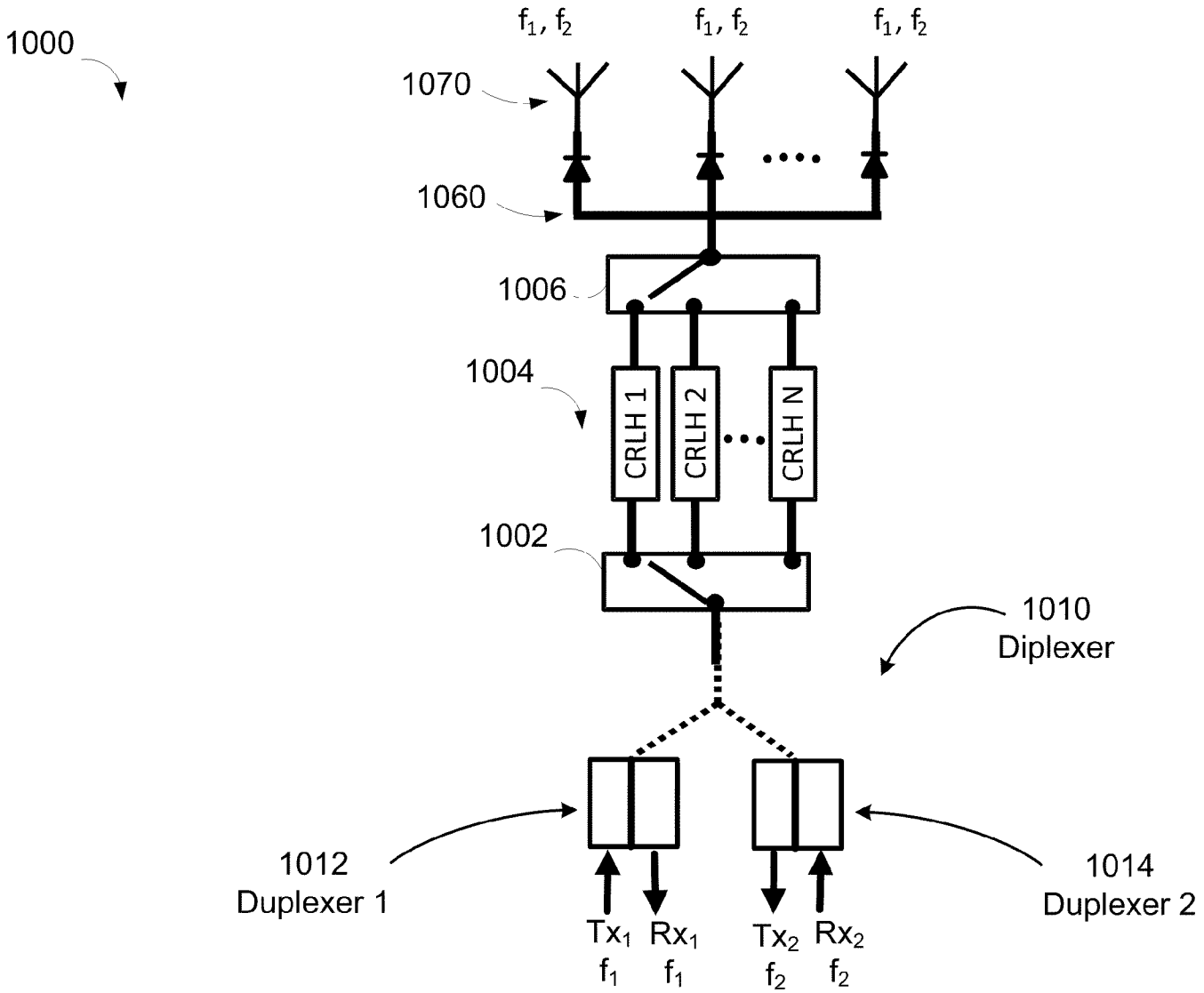

FIG. 11 illustrates a system 1000 including a power combiner/divider 1060, two switches 1002, 1006, an impedance matching circuit 1004, a diplexer 1010 and two duplexers for 1012, 1014, a dual-band operation of multiple antennas 1070. This system has the duplexer 1 and the duplexer 2, which are additional to the system of FIG. 10. The diplexer 1010 may be designed based on a CRLH structure to operate for the dual-band for both Tx and Rx modes. The duplexers 1 and 2 are coupled to the diplexer to direct respective signals, $Tx_1$ and $Rx_1$ signals in the $f_1$ band and $Tx_2$ and $Rx_2$ signals in the $f_2$ band, to right paths without mixing.

Figure 12:
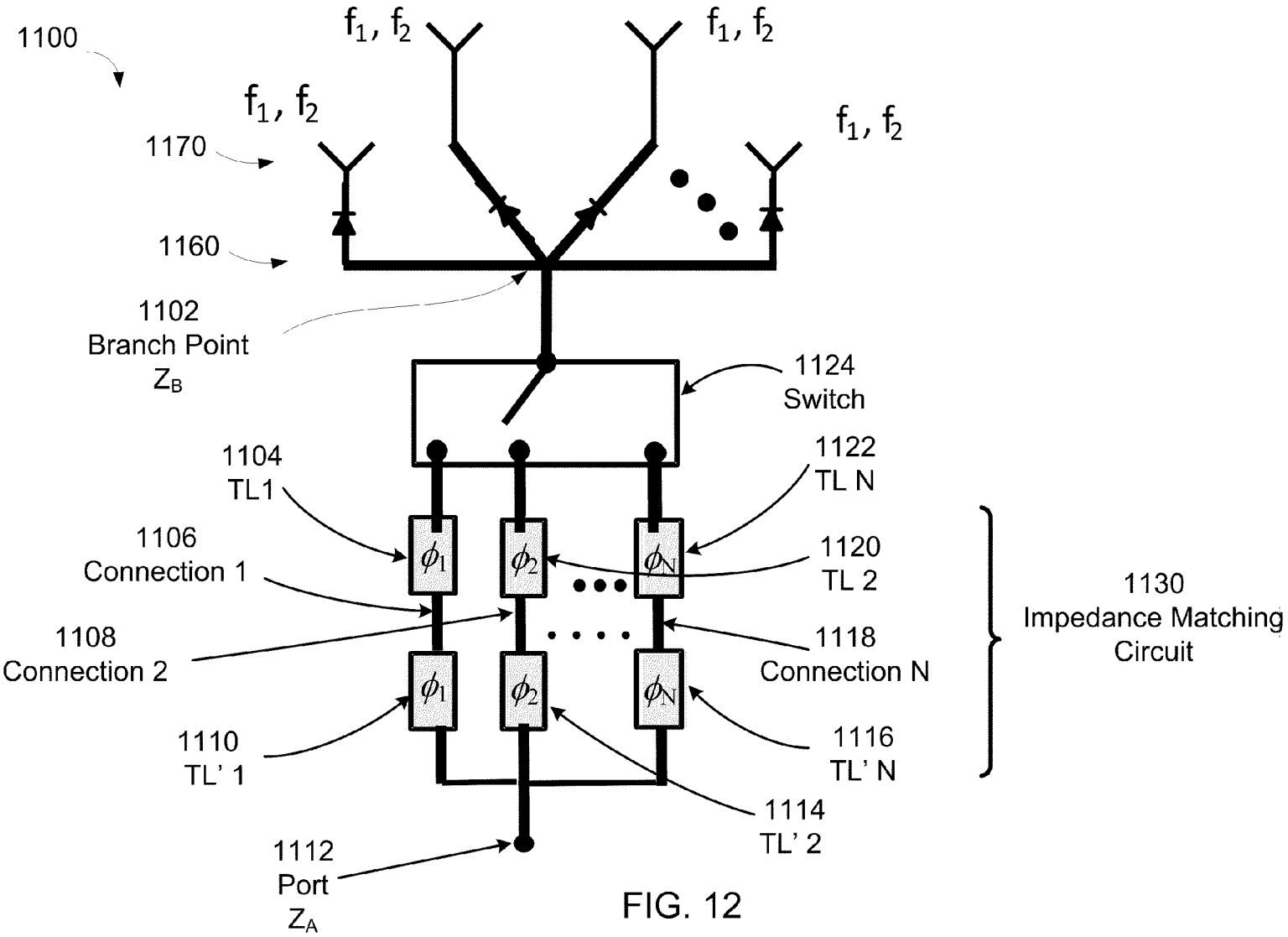

FIG. 12 illustrates a system 1100 including a power combiner/divider 1160, one switch 1124 and an impedance matching circuit 1130 connected to port 1112 and branch point 1102 for a dual-band operation of multiple antennas 1170. The impedance matching circuit 1130 includes transmission lines TL 1 1104, TL 2 1120 . . . , TL N 1122, TL' 1 1110, TL' 2 1114 . . . , and TL' N 1116, where TL 1 and TL' 1, TL 2 and TL' 2 . . . , and TL N and TL' N are coupled in parallel on the respective branches through connection 1 1106, connection 2 1108 . . . , and connection N 1118, respectively. As compared to the system of FIG. 9 where two switches are used, this system 1100 has one switch 1124 to couple first ends of the transmission lines TL 1, TL 2 . . . and TL N and second ends of the transmission lines TL' 1, TL' 2 . . . and TL' N are commonly coupled to the port. These transmission lines can be designed based on CRLH structures to have adequate phases for impedance matching. The switch is controlled to select the TL 1 and TL' 1 when one antenna is active, the TL 2 and TL' 2 when two antennas are active, . . . , and the TL N and TL' N when N antennas are active. Denoting the impedance at each of the antennas by $Z_0$, the impedance $Z_B$ at the branch point of the power combiner/divider can generally be expressed as $Z_B=Z_0/M$, where M is the number of active antennas and $1 \leq M \leq N$. By designing the CRLH structure of the TL' M to have the phase $\phi'_M=90° \pm (k \times 180°)$, where k=0, 1, 2 . . . , e.g., $\phi'_M=90°$ at $f_1$ and $\phi'_M=270°$ at $f_2$, with impedance $Z_M=Z_A$, the impedance $Z_A$ at the port can be transformed to $Z_A$ at the connection M. With this configuration, the impedance matching between the branch point having impedance $Z_B$ and the connection M having impedance $Z_A$ can be achieved by designing the CRLH structure for the TL M to provide the phase $\phi_4=90° \pm (k \times 180°)$, where k=0, 1, 2 . . . , e.g., $\phi_M=90°$ at $f_1$ and $\phi_M=270°$ at $f_2$, with impedance $Z_M=(Z_A \times Z_B)^{1/2}$ where $Z_B=Z_0/M$. These phase choices for the TLs 1–N and the TL's 1–N ensure that when one of the paths is active, each of the other paths has an open circuit at the port end due to the total phase difference of $\pm(k \times 180°)$, where k=0, 1, 2 . . . , between the switch end and the port end, thereby preventing signal mixing from the active path into wrong paths.

Figure 13:
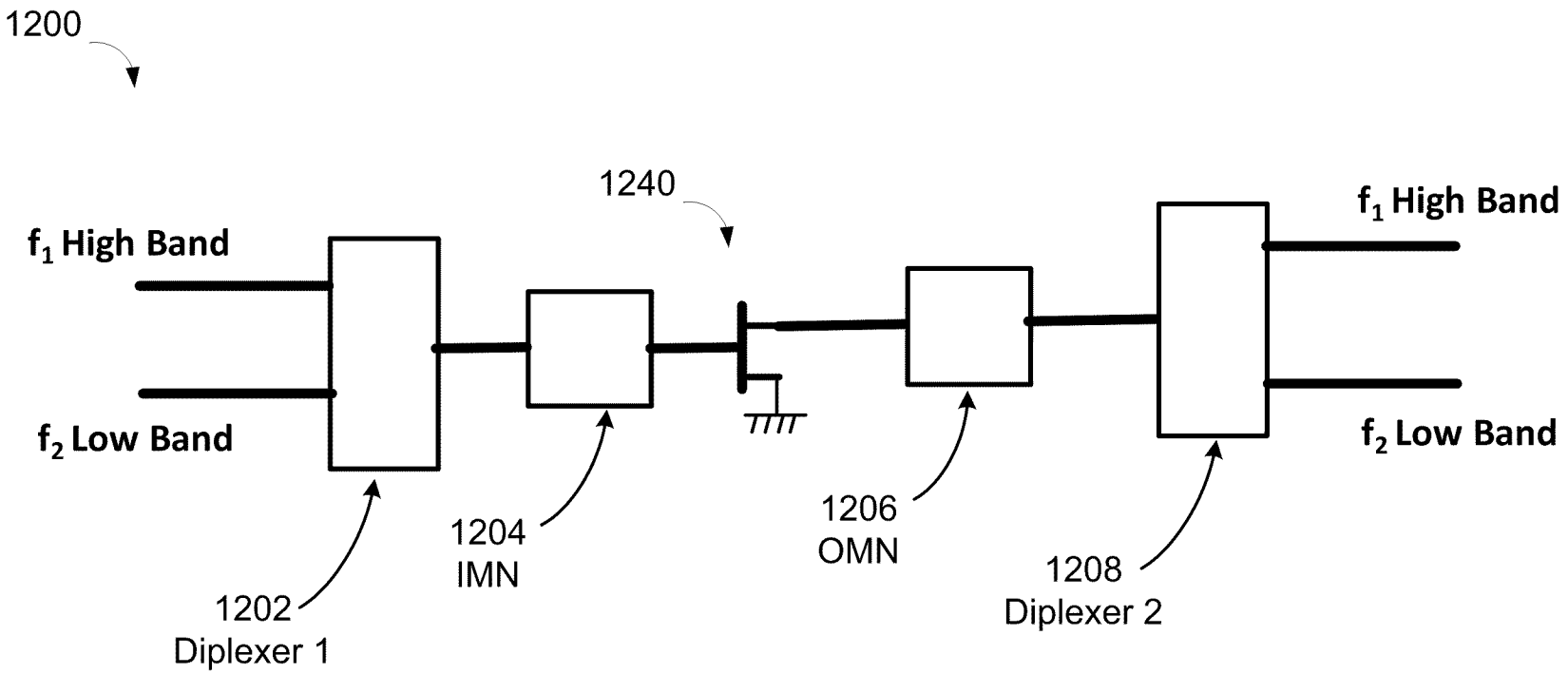

FIG. 13 illustrates a power amplifier system 1200 including a transistor 1240, an input side diplexer 1 1202, an Input Matching Network (IMN) 1204, an output side diplexer 2 1208, and an Output Matching Network (OMN) 1206 for a dual-band operation. The diplexers 1 and 2, the IMN and the OMN may be designed based on CRLH structures to operate for the dual-band. The two frequencies $f_1$ and $f_2$ represent high band and low band, respectively. The high band and low band signals are inputted to the system at different time intervals. The transistor 1240 amplifies the input signals to output signals. The diplexers 1 and 2 direct the signals to the right paths without mixing. The IMN and OMN process the signals for impedance matching. The subsystem including the transistor, the IMN and the OMN may be coupled directly to an input pin and an output pin of an external device to deliver signals in two bands. Note that the dual-band scheme illustrated in this document can be extended to a multiband scheme by utilizing similar CRLH structures, for example, Extended CRLH, E-CRLH, structures.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination. Only a few implementations are disclosed. However, it is understood that variations and enhancements may be made.

The invention claimed is:

1. A wireless device, comprising:

a plurality of antenna elements having Composite Right/Left Hand (CRLH) structures;

a power combiner/divider circuit coupled to each of the plurality of antenna elements, the power combiner/divider circuit having a plurality of feed paths, each having a diode; and a diplexer having a downstream end coupled to the power combiner/divider circuit, the diplexer having an upstream end operable to select between a plurality of paths for processing multiple frequency bands, a frequency band on one of the paths being different from a frequency band of a different path.

2. The wireless device of claim 1, wherein the power combiner/divider circuit comprising a CRLH structured transmission line.

3. The wireless device of claim 2, wherein the diplexer comprises a plurality of switches.

4. The wireless device of claim 3, wherein at least one of the plurality of switches supports transmit and receive signals.

5. The wireless device of claim 3, wherein a first switch of the plurality of switches is adapted to process signals in a first frequency band, and a second switch of the plurality of switches is adapted to process signals in a second frequency band.

6. The wireless device of claim 3, wherein the plurality of switches are single pole double throw switches.

7. The wireless device of claim 1, wherein the power combiner/divider comprises:

a branch point coupled to the diplexer; and a plurality of feed paths coupled to the branch point, the plurality of feed paths coupled to the plurality of antenna elements.

8. The wireless device of claim 1, wherein the diplexer comprises multiple diplexer paths, wherein a first diplexer path supports multiple transmit frequency bands and the second diplexer path supports multiple receive frequency bands.

9. The wireless device of claim 8, further comprising a switching element coupled between the diplexer and the power combiner/divider, wherein the switch is used to select the first diplexer path for transmission of signals or to select the second diplexer path to receive signals.

10. A wireless device comprising:

an antenna element, a power combiner/divider transmission line coupled to the antenna element; and a plurality of diplexers coupled to the power combiner/divider transmission line;

wherein each of the plurality of diplexers includes:

a downstream end coupled to the power combiner/divider transmission line; and an upstream end operable to select between a plurality of paths for processing multiple frequency bands, a frequency band on one of the paths being different from a frequency band of a different path.

11. The wireless device as in claim 10, wherein the power combiner/divider transmission line is a zero degree component.

12. The wireless device as in claim 11, wherein the power combiner/divider transmission line is a Composite Right Left Hand (CRLH) structure.

13. The wireless device as in claim 12, wherein the device supports dual band operation.

14. The wireless device as in claim 13, wherein each of the plurality of diplexers is coupled to the power combiner/divider transmission line at a port point having a first impedance value.

15. The wireless device as in claim 14, wherein each of the plurality of diplexers has a diplexing point having a second impedance value.

16. The wireless device as in claim 12, wherein the power combiner/divider comprises a plurality of unit cells, and wherein each unit cell has equivalent circuit parameters corresponding to an associated phase.

17. The wireless device as in claim 16, wherein a capacitance element is coupled between each of the diplexers and the power combiner/divider transmission line.

18. The wireless device as in claim 17, wherein a feed capacitance is coupled between the power combiner/divider transmission line and the antenna element.

19. The wireless device as in claim 16, wherein the associated phase is selected from the values of $\pm 2k \times 180°$ (k=0, 1, 2 . . . ).

20. The wireless device as in claim 19, wherein the equivalent circuit parameters and corresponding associated phases provide impedance matching between the plurality of diplexers and the antenna element.

* * * * *